US010274208B2

(12) United States Patent
Baetens et al.

(10) Patent No.: US 10,274,208 B2
(45) Date of Patent: Apr. 30, 2019

(54) AIR CONDITIONER

(71) Applicants: DAIKIN INDUSTRIES, LTD., Osaka-shi, Osaka (JP); DAIKIN EUROPE N.V., Ostend (BE)

(72) Inventors: Frans Baetens, Ostend (BE); Pieter Pirmez, Ostend (BE); Jan Vanooteghem, Ostend (BE)

(73) Assignees: DAIKIN INDUSTRIES, LTD., Osaka-Shi, Osaka (JP); DAIKIN EUROPE N.V., Ostend (BE)

( * ) Notice: Subject to any disclaimer, the term of this patent is extended or adjusted under 35 U.S.C. 154(b) by 0 days.

(21) Appl. No.: 15/766,203

(22) PCT Filed: Oct. 6, 2016

(86) PCT No.: PCT/JP2016/079839
§ 371 (c)(1),
(2) Date: Apr. 5, 2018

(87) PCT Pub. No.: WO2017/061564
PCT Pub. Date: Apr. 13, 2017

(65) Prior Publication Data

US 2018/0313550 A1 Nov. 1, 2018

(30) Foreign Application Priority Data

Oct. 6, 2015 (EP) ..... 15188535

(51) Int. Cl.
*F24F 1/00* (2011.01)
*F24F 1/0003* (2019.01)
(Continued)

(52) U.S. Cl.
CPC ..... *F24F 1/0003* (2013.01); *F24F 1/10* (2013.01); *F24F 1/28* (2013.01); *F25B 13/00* (2013.01);
(Continued)

(58) Field of Classification Search
CPC ... F24F 1/0003; F24F 1/28; F24F 1/10; F25B 13/00; F25B 41/003; F25B 2313/0215; F25B 2500/01
See application file for complete search history.

(56) References Cited

FOREIGN PATENT DOCUMENTS

CN 202126030 U 1/2012
CN 202521749 U 11/2012
(Continued)

OTHER PUBLICATIONS

European Search Report for 15188535, completed on Apr. 13, 2016.
(Continued)

*Primary Examiner* — Ana M Vazquez
(74) *Attorney, Agent, or Firm* — Birch, Stewart, Kolasch & Birch, LLP

(57) ABSTRACT

Air conditioner for conditioning a space inside a building includes a heat source unit and at least one indoor unit. The heat source unit has a heat exchanger unit and a compressor unit. The heat exchanger unit includes a first heat exchanger disposed in a first casing and configured to exchange heat with a heat source. The compressor unit includes a compressor disposed in a second casing separate from the first casing, the heat exchanger unit and the compressor unit being fluidly connected via a first liquid refrigerant pipe and a first gaseous refrigerant pipe. At least one indoor unit has a second heat exchanger configured to exchange heat with the space to be conditioned and being fluidly communicated to the heat exchanger unit and/or the compressor unit via a second liquid refrigerant pipe and a second gaseous refrigerant pipe. The outer diameter of the first liquid refrigerant pipe is larger than the outer diameter of the second liquid refrigerant pipe and/or the outer diameter of the first gaseous refrigerant pipe is larger than the outer diameter of the second gaseous refrigerant pipe.

4 Claims, 2 Drawing Sheets

(51) Int. Cl.

| | |
|---|---|
| ***F24F 1/10*** | (2011.01) |
| ***F24F 1/28*** | (2011.01) |
| ***F25B 13/00*** | (2006.01) |
| ***F25B 41/00*** | (2006.01) |

(52) U.S. Cl.
CPC ..... *F25B 41/003* (2013.01); *F25B 2313/021* (2013.01); *F25B 2313/0215* (2013.01); *F25B 2500/01* (2013.01)

(56) References Cited

FOREIGN PATENT DOCUMENTS

| | | | |
|---|---|---|---|
| CN | 203757858 | U | 8/2014 |
| EP | 2 108 897 | A1 | 10/2009 |
| JP | 08-200746 | A | 8/1996 |
| JP | 11-316067 | A | 11/1999 |
| JP | 11-337123 | A | 12/1999 |
| JP | 2000-39185 | A | 2/2000 |
| JP | 2007-93084 | A | 4/2007 |
| KR | 10-2004-0003621 | A | 1/2004 |
| WO | WO 2011/069220 | A1 | 6/2011 |

OTHER PUBLICATIONS

International Search Report for PCT/JP2016/079639 (PCT/ISA/210) dated Jan. 17, 2017.

International Preliminary Report on Patentability and Written Opinion of the International Searching Authority dated Apr. 10, 2018 for PCT/JP2016/079839.

International Preliminary Report on Patentability dated Apr. 19, 2018 for PCT/JP2016/079839.

Wanqing, "Installation Discussion on Air Cooled Special Air Conditioning for Computer Room", Refrigeration and Air Conditioning, vol. 10, Issue 5, Oct. 2010, 21 pages, with an English Translation.

[Fig. 1]
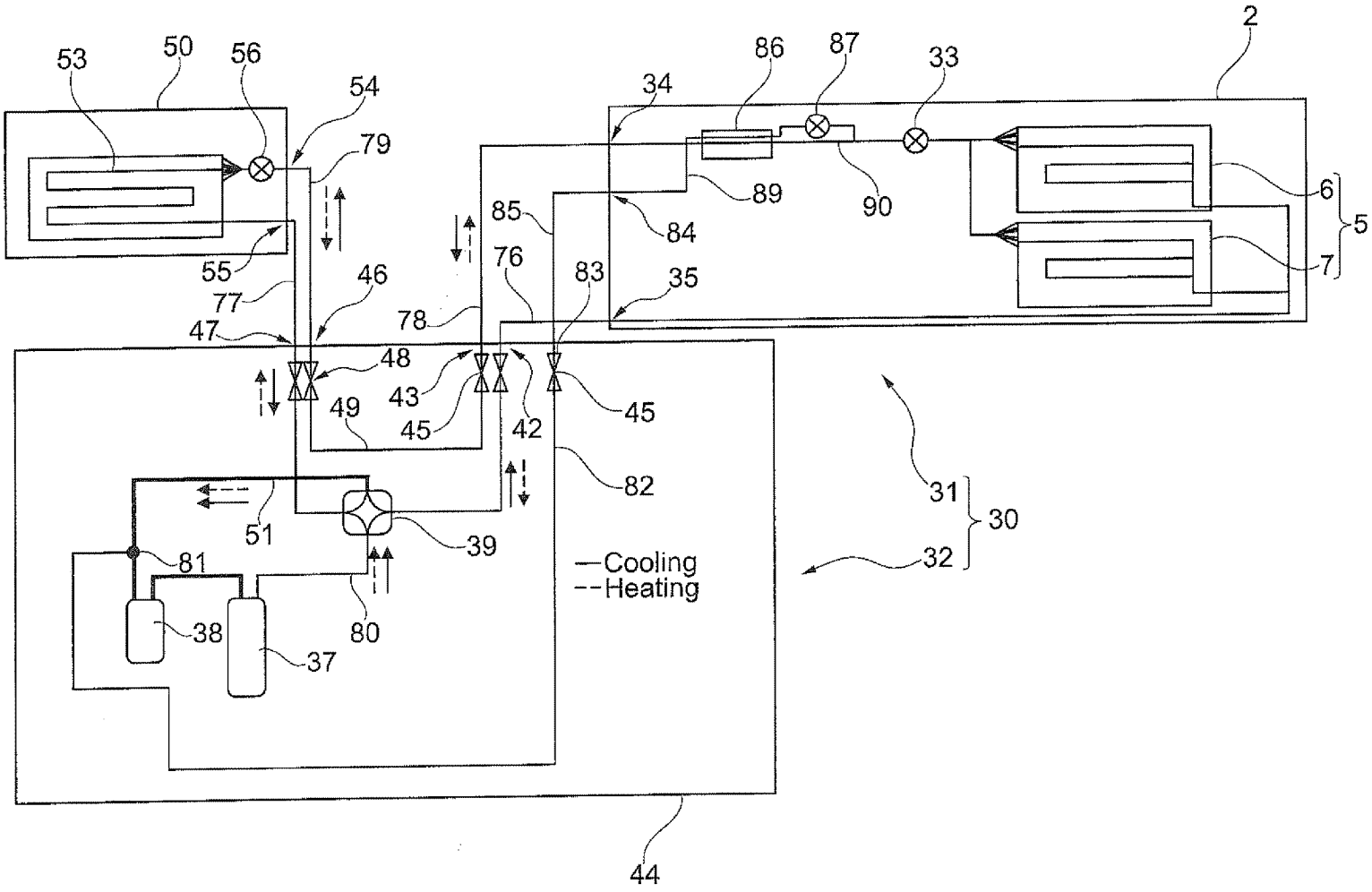

[Fig. 2]
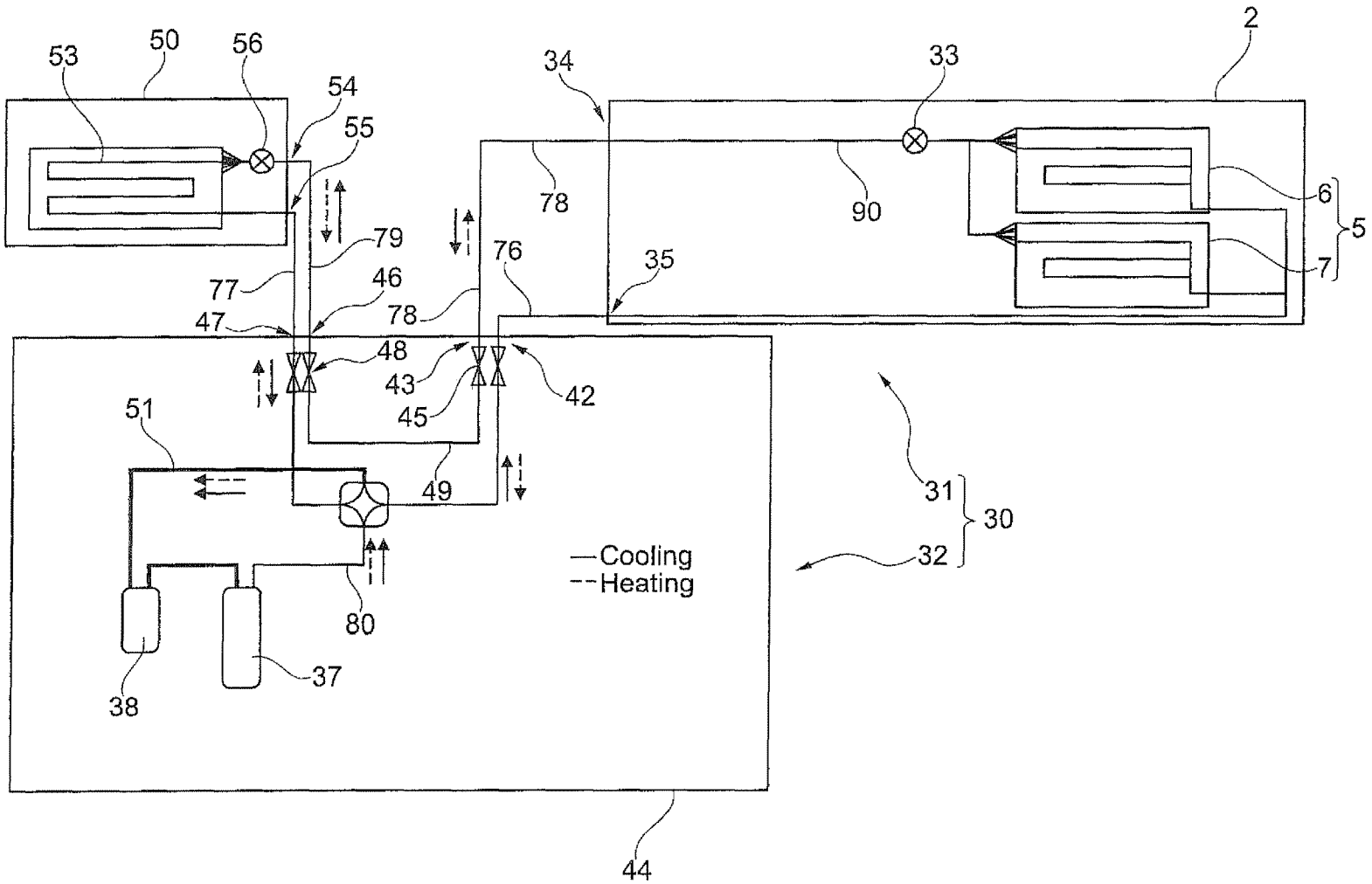

AIR CONDITIONER

TECHNICAL FIELD

The present invention relates to air-conditioners for conditioning a space inside a building and particularly air conditioners using outside air as heat source. Such air-conditioners may also be referred to as air heat pumps. Further, the air-conditioners may be used for cooling and/or heating of a space to be conditioned. More particular, the present invention relates to air-conditioners having a heat source unit comprising a heat exchanger unit having a heat exchanger and a compressor unit having a compressor with the heat exchanger being contained in a first casing of the heat exchanger unit and the compressor being accommodated in a second casing of the compressor unit.

BACKGROUND Art

Generally speaking, air-conditioners consist of one or more outdoor units and one or more indoor units connected via refrigerant piping defining a refrigerant circuit. The outdoor and indoor units each comprise a heat exchanger for, on the one hand, exchanging heat with the heat source and, on the other hand, exchanging heat with the space to be conditioned. Outdoor units of air-conditioners are in most cases installed outside a building for example on the roof or at the facade. This, however, has under certain circumstances been perceived as disadvantageous from an aesthetical point of view. Therefore, EP 2 108 897 A1 suggested to integrate the outdoor unit into a ceiling of the building so as to be hidden therein and not to be noticeable from the outside of the building.

CITATION LIST

PATENT LITERATURE

PTL 1: EP 2 108 897 A1

SUMMARY OF INVENTION

Technical Problem

Yet, the outdoor unit suggested in this document has certain disadvantages. One negative aspect is that the outdoor unit produces noises which may be perceived disturbing by individuals inside the building. A second negative aspect is installation and maintenance, because the outdoor unit is relatively heavy and because of its construction requires a relatively large installation space with respect to its height.

Solution to Problem

To cope with this problem, the present inventors suggest an air conditioner for conditioning a space, such as a room inside a building, as shown in FIG. 1 and comprising a heat source unit 30. In a particular embodiment, the heat source unit 30 uses outside air (i.e. air outside the building) as heat source. The heat source unit 30 is in prior art documents often defined as outdoor unit of the air conditioner. The heat source unit has a heat exchanger unit 31 (heat source heat exchanger unit) comprising a first heat exchanger (heat source heat exchanger) 5 and a first casing 2. The first heat exchanger 5 is disposed in the first casing 2 and configured to exchange heat with a heat source, particularly outside air.

Furthermore, the heat source unit 30 comprises a compressor unit 32. The compressor unit 32 has a compressor 37 and a second casing 44 separate from the first casing 2. "Separate" in this context means that the casings represent separate assemblies or units and should not encompass that one casing is disposed within the other casing. The compressor 37 is disposed in the second casing 44. The first heat exchanger 5 and the compressor 37 are connected by refrigerant piping. For this purpose, first and second refrigerant piping connections 34, 35 and 42, 43 are provided at each of the compressor unit 32 and the heat source unit 31. Preferably the first and second refrigerant piping connections are accessible from the outside of the first and/or second casing, respectively. Moreover, the air conditioner also comprises at least one indoor unit 50, the indoor unit having a second heat exchanger 53 configured to exchange heat with the space to be conditioned or more particular air within this space. The second heat exchanger 53 is also fluidly communicated to the heat exchanger unit 31 and/or the compressor unit 32. This is as well obtained by refrigerant piping and providing third and fourth refrigerant piping connections 46, 47 and 54, 55 at the indoor unit 50 and the compressor unit 32. In particular, the indoor heat exchanger 53 and the heat source heat exchanger 5 are connected by a liquid refrigerant piping 78, 79 and 49 via the compressor unit 32 using said refrigerant piping connections 34, 43, 46 and 54. However, the indoor heat exchanger 53 and the heat source heat exchanger 5 could also be directly connected by one liquid refrigerant piping using the refrigerant piping connections 34 and 54. Furthermore the indoor heat exchanger 53 and the heat source heat exchanger 5 are each connected to the compressor 37 of the compressor unit 32, particularly a 4-way valve 39 contained therein by a gaseous refrigerant pipe 76, 77, respectively. According to this air conditioner, the heat exchanger unit 31 may be disposed inside the building and fluidly communicated to the outside of the building. In particular and as previously mentioned, the heat exchanger unit 31 takes the outside air in and exhausts air heated/cooled by the first heat exchanger to the outside. The compressor unit 32 in turn can be located inside or outside the building.

Because the heat source unit 30 is split into a heat exchanger unit 31 and a compressor unit 32, the respective casings may be optimized with respect to size and noise insulation. Further, the splitting enables different positioning of the two units, wherein the heat source unit may be disposed in the ceiling or a wall of the building without any restrictions regarding noise and being hidden to comply with the aesthetical requirements. At the same time, the heat exchanger unit is reduced in weight not comprising the compressor. Therefore, installation in the ceiling and maintenance are improved. The compressor unit in turn may be installed at a location where noises are no problem and because of its weight preferably at a lower height compared to the heat exchanger unit and even more preferably on the floor. In addition and because of the lower size of the compressor unit as compared to prior art outdoor units also comprising the first heat exchanger, the compressor unit may even be disposed outside without impairing the aesthetical appearance. An additional advantage of separating the compressor unit and the heat exchanger unit is that noises from the compressor usually entrained by the air passing the heat exchanger unit and thereby transferred to the space to be conditioned disturbing the individuals within the space can be avoided.

One problem associated with this kind of system is, however that because of the connection of the heat source heat exchanger and the indoor heat exchanger via the compressor unit and the splitting of the former outdoor unit into a heat source unit 31 and a compressor unit 32, the lengths of the piping 76 and 78 connecting the heat source heat exchanger and the indoor heat exchanger as well as the heat source heat exchanger and the compressor are increased resulting in a relatively high pressure drop in the pipes during operation. In particular, if the air conditioner is operated in a heating mode for heating the space to be conditioned, there is a significant pressure loss in the suction gaseous refrigerant piping (78 in the drawings) connecting the heat source unit and the compressor unit or more particularly the suction side of the compressor and the heat source heat exchanger. If the air conditioner is operated in a cooling mode for cooling the space to be conditioned, there is a significant pressure loss in the liquid refrigerant piping connecting the heat source unit and the compressor unit. In some cases, the pressure drop can be compensated by the compressor. The result of such compensation is a higher power consumption and an increased discharge superheat which needs to be compensated by the heat source heat exchanger in cooling operation. Thereby, the efficiency and capacity of the system is decreased.

To overcome this disadvantage, the present inventors suggest incorporating a subcooling unit having a subcooling heat exchanger 86 in order to create extra subcooling in the piping between the compressor unit 32 and the heat exchanger unit 31. As shown in FIG. 1, a refrigerant piping 82 is connected at a position 81 upstream of the accumulator 38 (between the 4 way valve 39 and the accumulator 38) to the refrigerant circuit. A fifth refrigerant piping connection 83 is provided at the compressor unit 32 again provided with a stop valve 45. A fifth gaseous refrigerant pipe 85 is connected to the refrigerant piping connection 83 and a further refrigerant piping connection 84 provided at the heat exchanger unit 31. A refrigerant piping 89 within the casing 2 of the heat exchanger unit 31 is connected to the refrigerant piping connection 84, passes the subcooling heat exchanger 86, passes a subcooling expansion valve 87 and is then connected to the refrigerant piping 90, connecting the first refrigerant piping connection 34 and the main expansion valve 33. Thereby a cooling capacity loss can be decreased because of the extra subcool achieved thereby. Yet, in order to avoid such cooling capacity loss, extra pipe work including the pipes 82, 85 and 89 and the associated pipework at the time of installation are required. In addition the system requires the subcooling heat exchanger 86, the expansion valve 87 and the incorporation of a control into the system for controlling the subcooling process. Thus, this countermeasure increases the costs for the air conditioner and makes it more complicated.

Accordingly, it is the object of the invention to improve an air conditioner having a heat source unit and a compressor unit as described above in regard of efficiency and capacity avoiding extra piping and installation work.

This object is achieved by the subject matter as described herein. Embodiments of the invention are detailed in the following description and the accompanying drawings.

According to one aspect, an air conditioner for conditioning a space, such as a room inside a building, comprises a heat source unit. In a particular embodiment, the heat source unit uses outside air (i.e. air outside the building) as heat source. The heat source unit is in prior art documents often defined as outdoor unit of the air conditioner. The heat source unit has a heat exchanger unit (heat source heat exchanger unit) comprising a first heat exchanger (heat source heat exchanger) and a first casing. The first heat exchanger is disposed in the first casing and configured to exchange heat with a heat source, particularly outside air. For this purpose, it is preferred that the first casing has a first connection at one side of the heat exchanger and a second connection at an opposite side of the heat exchanger. The first and second connections are preferably connected to ducting fluidly communicated with the outside of the building so that outside air may pass the first heat exchanger. Furthermore, the heat source unit comprises a compressor unit. The compressor unit has a compressor and a second casing separate from the first casing. "Separate" in this context means that the casings represent separate assemblies or units and should not encompass that one casing is disposed within the other casing. The compressor is disposed in the second casing. The heat exchanger unit (particularly the first heat exchanger) and the compressor unit (particularly the compressor) are connected by refrigerant piping, particularly a first liquid refrigerant pipe and/or a first gaseous refrigerant pipe. Moreover, the air conditioner also comprises at least one indoor unit, the indoor unit has a second heat exchanger (indoor heat exchanger) configured to exchange heat with the space to be conditioned or more particular air within this space. The indoor heat exchanger is also fluidly communicated to the heat exchanger unit (particularly the first heat exchanger) and the compressor unit (particularly the compressor) by refrigerant piping, particularly a second liquid refrigerant pipe and a second gaseous refrigerant pipe. In order to fluidly communicate the second heat exchanger, the first heat exchanger and the compressor, first and second refrigerant piping connections are provided at each of the compressor unit and the heat exchanger unit and third and fourth refrigerant piping connections are provided at each of the compressor unit and the indoor unit. In a particular embodiment, the first liquid refrigerant pipe is connected to the second refrigerant piping connections of the compressor unit and the heat exchanger unit and the first gaseous refrigerant pipe is connected to the first refrigerant piping connections of the compressor unit and the heat exchanger unit. The second liquid refrigerant pipe is connected to the third refrigerant piping connections of the compressor unit and the indoor unit and the second gaseous refrigerant pipe is connected to the fourth refrigerant piping connections of the compressor unit and the indoor unit. Further, the second refrigerant piping connection and the third refrigerant piping connection of the compressor unit may be connected within the second casing by a connecting refrigerant pipe, wherein the heat exchanger unit is connected to the indoor unit via the first liquid refrigerant pipe, the connecting refrigerant piping within the second casing and the second liquid refrigerant pipe. Yet, as mentioned in the introductory portion, the heat source heat exchanger may as well be directly connected to the indoor heat exchanger/-s using one liquid refrigerant pipe. In this case, there will be no first and second liquid refrigerant pipe, but only one liquid refrigerant pipe directly connecting the heat exchanger unit and the indoor units. According to the invention, the outer diameter of the first liquid refrigerant pipe is larger than the outer diameter of the second liquid refrigerant pipe and/or the outer diameter of the first gaseous refrigerant pipe is larger than the outer diameter of the second gaseous refrigerant pipe. In this context, it is to emphasize that in a case in which a plurality of indoor units are connected to the system the above refers to the outer diameter of the main liquid and gaseous refrigerant pipe connecting to the plurality of indoor units. More particular, a main liquid and gaseous refrigerant pipe is connected to the refrigerant circuit (the compressor and the heat source heat exchanger as explained above) and a plurality of branch pipes connects the main refrigerant pipe to the plurality of indoor units. For the calculation of the diameter increase, the outer diameter of the main refrigerant pipes is to be selected. By increasing the outer diameter of the first liquid refrigerant pipe as compared to the second liquid refrigerant pipe that is in relation to the normally selected diameter of the air conditioner's heat source unit (cooling) capacity, the cooling capacity loss can be avoided. By increasing the outlet diameter of the first gaseous refrigerant pipe as compared to the second gaseous refrigerant pipe that is in comparison to the normally selected diameter of the air conditioner's heat source unit (cooling) capacity, the loss of heating capacity can be avoided. Thus, the present invention provides an air conditioner having an increased efficiency without requiring additional pipework, installation and other refrigerant components. In a case for example in which the heat source heat exchanger is directly connected to the indoor heat exchanger/-s an increase of diameter of the liquid refrigerant pipe may not be required, because the length of the liquid refrigerant pipe can be kept short by the direct connection. In such an embodiment it may, therefore, be conceivable to only increase the diameter of the gaseous refrigerant pipe.

Preferably the outer diameter of the first liquid refrigerant pipe is between 30% to 70% larger than the outer diameter of the second liquid refrigerant pipe. In this context, the lower limit is actually defined by the pipe sizes available on the market and complying with the normative DIN EN 12735-1:2010 (E). The upper limit is selected for technical reasons. A further increase may lead to a critical liquid refrigerant control of the system. More particular, if the outer diameter is increased more than 70%, more refrigerant is required in the system. As a result refrigerant control of the system is more difficult, particularly when switching between cooling and heating operation. A further disadvantage is that an even further increase has a negative impact on the costs, because more refrigerant is needed.

According to a further embodiment, the outer diameter of the first gaseous refrigerant pipe is between 15% to 45% larger than the outer diameter of the second gaseous refrigerant piping. Also in this context, the lower limit of the increase is defined by the available pipe sizes and complying with the normative DIN EN 12735-1:2010 (E), whereas the upper limit is selected for technical reasons. If the diameter would be increased even more than 45%, a problem can occur that oil entrained in the refrigerant cannot reliably be returned to the compressor. In particular, the refrigerant flow drops if the outer diameter is increased too much and oil will not be entrained by the refrigerant anymore. Thus, the oil remains in the piping and is not returned to the compressor for its lubrication.

Preferably, the increase of the diameter is performed at the site of the air conditioner during installation in that the pipe fitter selects a first pipe size for the connection of the indoor unit and the compressor unit and selects a different and larger second pipe size for the connection of the compressor unit and the heat exchanger unit.

Further features and effects of the heat source unit may be obtained from the following description of embodiments. In the description of these embodiments reference is made to the accompanying drawings.

BRIEF DESCRIPTION OF DRAWINGS

FIG. 1 shows a schematic circuit diagram of an air conditioner according to a first concept developed by the present inventors but not covered by the claims, and FIG. 2 shows a schematic circuit diagram of an air conditioner according to an embodiment of the invention.

DESCRIPTION OF EMBODIMENTS

FIG. 2 shows the circuit diagram of an air conditioner. The air-conditioner has a heat source unit 30 comprising a heat exchanger unit 31 and a compressor unit 32.

The heat exchanger unit 31 comprises a heat exchanger 5 (first heat exchanger) which consists of an upper heat exchanger element 6 and a lower heat exchanger element 7 connected in parallel. The heat exchanger unit 31 further comprises the main expansion valve 33 of the refrigerant circuit.

The heat exchanger unit 31 comprises a casing 2 (first casing) being configured for connection to an outside air duct of an air conditioner. In particular, the heat exchanger unit is configured as an "outdoor" unit of an air conditioner which is, however, disposed inside particularly within the ceiling of a building. Hence, a first connection is provided at the casing 2 for connection to an air duct communicating the heat exchanger unit 31 with the outside of the building and so as to enable taking of outdoor air into the casing 2. A connection, provided for the connection of the heat exchanger unit 31 to the air duct again leading to the outside of the building and to enable exhausting of air having passed the heat exchanger 5 to the outside, is disposed at an opposite end of the casing 2.

The casing 2 has a first and second refrigerant piping connection 34 and 35 for connecting the heat exchanger unit 31 to the refrigerant piping of the refrigerant circuit.

The compressor unit 32 has a casing 44 (second casing). A compressor 37 is disposed in the casing 44 (second casing). Furthermore, all other components of the compressor unit described below and if present will be disposed in the casing 44 as well. In addition, the compressor unit may comprise an optional accumulator 38 and a 4-way valve 39. The compressor unit 32 further comprises first and second refrigerant piping connections 42 and 43.

A stop valve 45 (two stop valves, one for each connection 42, 43) may be provided close to the first and second refrigerant piping connections 42 and 43, respectively.

Further a third and fourth refrigerant piping connection 46 and 47 are provided for connection of one or more indoor units 50 (one in the present embodiment) disposed in fluid communication with the space to be conditioned. A stop valve 48 (two stop valves, one for each connection 46, 47) is also provided close to the refrigerant piping connections 46 and 47, respectively.

Moreover, a refrigerant piping 80 (second refrigerant piping) connects the refrigerant piping connection 42 and the refrigerant piping connection 47 with the 4 way valve 39, the compressor 37, the optional accumulator 38, and the 4-way valve 39 being interposed in this order.

The aforesaid components are disposed in the following order from the refrigerant piping connection 47 to the refrigerant piping connection 42 considering cooling operation (solid arrows in FIG. 2): the refrigerant piping connection 47, the 4-way valve 39, the accumulator 38, the compressor 37, the 4 way valve 39 and the refrigerant piping connection 42. The aforesaid components are disposed in the following order from the refrigerant piping connection 42 to the refrigerant piping connection 47 considering heating operation (broken arrows in FIG. 1): the refrigerant piping connection 42, the 4-way valve 39, the optional accumulator 38, the compressor 37, the 4-way valve 39 and the refrigerant piping connection 47.

Furthermore, a refrigerant piping (connecting refrigerant piping) 49 connects the refrigerant piping connection 43 and the refrigerant piping connection 46. A refrigerant piping 51 connects the accumulator 38 (the accumulator 38 is preferably a suction accumulator) and the 4-way valve 39.

An example of an indoor unit 50 comprises an indoor heat exchanger 53 (second heat exchanger) connected respectively via the refrigerant piping connections 54 and 55 and a refrigerant piping (see later) to the third and fourth refrigerant connections 46 and 47 of the compressor unit 32. Optionally, the indoor unit 50 may comprise an indoor expansion valve 56 disposed between the indoor heat exchanger 53 and the refrigerant piping connection 54. The indoor unit 50 may in principle be configured as a common indoor units used in such air-conditioners.

The heat exchanger unit 31 is connected by gaseous and liquid refrigerant piping 76, 78 to the compressor unit 32 using the refrigerant piping connections 34 and 35 as well as 43 and 42, respectively. The compressor unit 32 again is connected to the indoor unit/-s 50 via a gaseous and liquid refrigerant piping 77, 79 using the refrigerant piping connections 46, 47 and 54, 55 respectively. More particular, the heat source heat exchanger 5 is connected via the refrigerant piping connection 34, the first liquid refrigerant pipe 78, the refrigerant piping connection 43 the connecting refrigerant piping 49, the refrigerant piping connection 46, the second liquid refrigerant pipe 79 and the refrigerant piping connection 54 to the indoor heat exchanger 53. On the other hand, the heat source heat exchanger 5 is connected via the refrigerant piping connection 35, the first gaseous refrigerant pipe 76, the refrigerant piping connection 42 to the 4 way valve 39 and the indoor heat exchanger 53 is connected via the refrigerant piping connection 55, the second gaseous refrigerant pipe 77, the refrigerant piping connection 47 to the 4 way valve 39.

The operation of the air conditioner described above is as follows. During cooling operation (solid arrows in FIG. 1), refrigerant flows into the compressor unit 32 at the refrigerant piping connection 47 passes the 4-way valve 39 and is introduced into the accumulator 38. When passing the accumulator associate liquid refrigerant is separated from the gaseous refrigerant and liquid refrigerant is temporarily stored in the accumulator 38.

Subsequently, the gaseous refrigerant is introduced into the compressor 37 and compressed. The compressed refrigerant is introduced into the heat exchanger unit 31 via the refrigerant piping connections 42, 35 and the gaseous refrigerant pipe 76. The refrigerant passes the heat exchanger 5 with its plates 6, 7 of the heat exchanger unit 31, whereby the refrigerant is condensed (the heat exchanger 5 functions as a condenser). Hence, heat is transferred to the outside air parallel passing through the heat exchanger elements 6, 7 of the heat exchanger 5. The expansion valve 33 is entirely opened to avoid high pressure drops during cooling. Then, the refrigerant flows into the compressor unit 32 via the refrigerant piping connections 34, 43 and the liquid refrigerant pipe 78. In the compressor unit 32, the refrigerant flows through the connecting refrigerant piping 49 being introduced via the refrigerant piping connection 46, the second liquid refrigerant pipe 79 and the third refrigerant connection 54 into the indoor unit 50 and particularly its heat exchanger 53. The refrigerant is then further expanded by the indoor expansion valve 56 and evaporated in the heat exchanger 53 (the heat exchanger 53 functions as evaporator) cooling the space 72 to be conditioned. Accordingly, the heat is transferred from air in the space to be conditioned to the refrigerant flowing through the heat exchanger 53. Finally, the refrigerant is again introduced via the refrigerant piping connections 55, 47 and that gaseous refrigerant pipe 77 into the compressor unit 32. In the compressor unit 32 the refrigerant first flows through the 4 way valve 39 and then into the accumulator 38.

During heating, this circuit is reversed wherein heating is shown by the broken arrows in FIG. 1. The process is in principle the same. Yet, the first heat exchanger 5 functions as evaporator whereas the second heat exchanger 53 functions as condenser during heating. In particular, refrigerant is introduced into the compressor unit 32 by the first gaseous refrigerant pipe 76 via the refrigerant piping connection 42, flows via the 4-way valve 39 into the accumulator 38 and is then compressed in the compressor 37 before flowing into the 4-way valve 39 and through the refrigerant piping connections 47, 55 and the second gaseous refrigerant pipe 77 into the indoor unit 50 and particularly the indoor heat exchanger 53 where the refrigerant is condensed (the indoor heat exchanger 53 functions as a condenser). Subsequently, the refrigerant is expanded by the expansion valve 56 and then reintroduced via the refrigerant piping interconnections 54, 46 and the second liquid refrigerant pipe 79 into the compressor unit 32 where the refrigerant flows into the connecting refrigerant piping 49. Subsequently, the refrigerant flows into the heat exchanger unit 31 via the refrigerant piping connections 43 and 34 and the first liquid refrigerant pipe 78. The refrigerant is further expanded by the main expansion valve 33 in the heat exchanger unit 31 and then evaporated in the heat exchanger 5 (the heat exchanger 5 functions as evaporator) before being reintroduced into the compressor unit 32 via the refrigerant piping connections 35 and 42 and the first gaseous refrigerant pipe 76.

Because of the splitting of the compressor unit 32 and the heat exchanger unit 31, the compressor unit 32 may be installed in areas that are not noise sensitive so that there is no noise disturbance caused by the compressor even though disposed indoors. In addition the casing 44 of the compressor unit 32 may be well insulated with sound insulation. Even further, there is no compressor noise in the air flowing through the heat exchanger unit 31 due to the split concept between the heat exchanger unit 31 and the compressor unit 32 which could be transferred into the space to be conditioned.

Because of the lower weight per unit of the heat exchanger unit 31 and the compressor unit 32, the installation is improved. In addition, the compressor unit 32 may be installed on the floor so that there is no need to lift the heavy compressor module. Because of a relatively small footprint (width and depth) of the compressor unit 32 and a lower height of the compressor unit 32 and particularly its casing 44, the compressor unit 32 may even be hidden when disposed inside the room to be conditioned such as below a cupboard or counter-board.

The heat exchanger unit 31 has also the advantage that there is no noise disturbance. Because the compressor is not contained in the heat exchanger unit 31 the only sound that can be entrained in the airstream is the noise of the fan whereby the noise in the airstream is drastically reduced. Further, the casing can be entirely closed to the space 72 to be conditioned so that no sounds are transferred into the space. Also this casing may be well insulated with sound insulation. Because of the lower height of the heat exchanger unit 31, it is easy to hide the unit for example in the ceiling. Therefore, the unit 31 is not visible from the outside. The installation is also improved because of the lower weight as compared to units having the compressor in the same casing.

Usually, the pipe outer diameters for the gaseous and liquid refrigerant pipes are selected depending on the capacity of the "outdoor unit", that is the heat source unit 30. In addition, the pipe outer diameter is governed by the pipe diameter available on the market and complying with the relevant normative, presently DIN EN 12735-1:2010 (E) differentiating between a metric and an imperial series and defining the outer diameter of the corresponding pipes. As a consequence, the pipe inner diameter, which is the relevant portion is indirectly selected, because the normative only refers to the outer diameter but defines the wall thickness of the pipes and thereby indirectly in the inner diameter. The table below corresponds the usual (normal or standard) piping outer diameter sizes related to the relevant capacities of the heat source unit.

| | Imperial piping outer diameter size (mm) | | Metric piping outer diameter size (mm) | |
|---|---|---|---|---|
| Heat source unit cooling capacity X (kW) | Gaseous refrigerant pipe | Liquid refrigerant pipe | Gaseous refrigerant pipe | Liquid refrigerant pipe |
| $1.7 \leq X \leq 5.6$ | 12.7 | 6.4 | 12 | 6 |
| $5.6 < X < 16.8$ | 15.9 | 9.5 | 15 | 10 |
| $16.8 \leq X \leq 22.4$ | 19.1 | 9.5 | 18 | 10 |
| $22.4 < X < 32.4$ | 22.2 | 9.5 | 22 | 10 |
| $32.4 \leq X < 47.0$ | 28.6 | 12.7 | 28 | 12 |
| $47.0 \leq X < 71.7$ | 28.6 | 15.9 | 28 | 15 |
| $71.7 \leq X < 103$ | 34.9 | 19.1 | 35 | 18 |
| $103 \leq X$ | 41.3 | 19.1 | 42 | 18 |

According to the present invention, the first gaseous refrigerant pipe 76 and/or the first liquid refrigerant pipe 78 have an outer diameter that is increased compared to the aforesaid normal outer diameter shown in the table. In this context, it is preferred that the outer diameter of the first gaseous refrigerant pipe 76 is increased compared to the normal outer diameter shown in the above table by 15% to 45% and/or that the outer diameter of the first liquid refrigerant pipe 78 is increased compared to the normal outer diameter shown in the above table by 30% to 70%. Thus, the present invention may alternatively to the definition of the outer pipe diameter of the first gaseous and liquid refrigerant pipe in comparison to the second gaseous and liquid refrigerant pipe (as in the claims) also be defined in relation to the standard outer diameter of the first gaseous and liquid refrigerant pipe shown in the above table in dependency of the capacity of the heat source unit.

In the present embodiment, the outer diameter of the second gaseous refrigerant pipe 77 and the second liquid refrigerant pipe 79 is selected in accordance with the standard outer diameter size given in the above table. Hence, the outer diameter of the first gaseous and liquid refrigerant pipe 76 and 78 is increased in between 15% to 45% and 30% to 70% also in comparison to the second gaseous and liquid refrigerant pipe 77 and 79. In this context, it is to emphasize that in a case in which a plurality of indoor units are connected to the system the above refers to the outer diameter of the main liquid and gaseous refrigerant pipe connecting to the plurality of indoor units. In general, a main liquid and gaseous refrigerant pipe is connected to the refrigerant circuit (the compressor and the heat source heat exchanger) and a plurality of branch pipes connects the main refrigerant pipe to the plurality of indoor units. For the calculation of the diameter increase, the outer diameter of the main refrigerant pipes is to be selected.

The upper border of 45% is given because an even further increase of the outer diameter would lead to problems of oil entrained in the refrigerant remaining in the system rather than being returned to the compressor. The lower limit of 15% is defined by the pipes available on the market in accordance with the above normative.

The upper border of 70% is given because and even higher outer diameter would lead to problems with respect to the liquid refrigerant control within the system whereas the lower border of 30% is again defined by the pipes available on the market in accordance with the above normative.

In a particular example of a heat source unit 31 having a capacity of 5 kW, the outer diameter of the second gaseous refrigerant pipe 77 is 15.9 mm and the outer diameter of the second liquid refrigerant pipe 79 is 9.5 mm. According to the invention, the outer diameter of the first gaseous refrigerant pipe 76 resides in a range between 18.285 mm and 23.055 mm and is in one particular embodiment 19.1 mm. The outer diameter of the first liquid refrigerant pipe 78, hence, resides in a range between 12.35 mm and 16.15 mm and is in one particular embodiment 12.7 mm.

By increasing the diameter of the gaseous refrigerant pipe a loss in heating capacity of the air conditioner can be avoided, whereas increasing the diameter of the liquid refrigerant pipe avoids a loss in cooling capacity of the air conditioner. As compared to the separate solution defined in the introductory portion of the present application with respect to FIG. 1, no extra pipes 82, 85 and 89, no extra installation work for the pipes and no further refrigerant components such as the subcooling heat exchanger 86 and a subcooling electronic expansion valve 87 as well as extra control software are necessary. The only measure is that the pipe fitter at the site of the air conditioner selects a pipe for the first gaseous and liquid refrigerant pipe 76 and 78 having an outer diameter larger than the standard pipe diameter that would have been used for these pipes in an air conditioner depending on the capacity of the heat source unit of the air conditioner within the above range and/or larger than the second gaseous and liquid refrigerant pipe 77 and 79 to achieve the effects of the present invention. Thus, the present invention provides a simple and straightforward solution to solve the above mentioned problem.

The invention claimed is:

1. An air conditioner for conditioning a space inside a building comprising:

a heat source unit having a heat exchanger unit comprising a first heat exchanger disposed in a first casing and configured to exchange heat with a heat source and a compressor unit comprising a compressor disposed in a second casing separate from the first casing, the heat exchanger unit and the compressor unit being fluidly connected via a first liquid refrigerant pipe and/or a first gaseous refrigerant pipe; and at least one indoor unit having a second heat exchanger configured to exchange heat with the space to be conditioned and being fluidly communicated to the heat exchanger unit and/or the compressor unit via a second liquid refrigerant pipe and a second gaseous refrigerant pipe, wherein the outer diameter of the first liquid refrigerant pipe is larger than the outer diameter of the second liquid refrigerant pipe and/or the outer diameter of the first gaseous refrigerant pipe is larger than the outer diameter of the second gaseous refrigerant pipe.

2. The air conditioner according to claim 1, wherein outer diameter of the first liquid refrigerant pipe is between 30% to 70% larger than the outer diameter of the second liquid refrigerant pipe.

3. The air conditioner according to claim 2, wherein the outer diameter of the first gaseous refrigerant pipe is between 15% to 45% larger than the outer diameter of the second gaseous refrigerant piping.

4. The air conditioner according to claim 1, wherein the outer diameter of the first gaseous refrigerant pipe is between 15% to 45% larger than the outer diameter of the second gaseous refrigerant piping.

* * * * *